United States Patent [19]

Arai et al.

[11] Patent Number: 5,070,005

[45] Date of Patent: Dec. 3, 1991

[54] PROCESS FOR PRODUCING SILVER HALIDE PHOTOGRAPHIC MATERIALS

[75] Inventors: Takeo Arai; Mariko Kato; Toshiharu Nagashima, all of Hino, Japan

[73] Assignee: Konica Corporation, Tokyo, Japan

[21] Appl. No.: 676,748

[22] Filed: Mar. 28, 1991

[30] Foreign Application Priority Data

Apr. 5, 1990 [JP] Japan ..... 2-91228

[51] Int. Cl.[5] ..... G03C 1/76

[52] U.S. Cl. ..... 430/523; 430/950

[58] Field of Search ..... 430/523, 950

[56] References Cited

U.S. PATENT DOCUMENTS 3,635,714 1/1972 Oshibuchi et al. ..... 430/950
4,429,322 10/1983 Ezaki et al. ..... 430/523
4,447,525 5/1984 Vallarino et al. ..... 430/950
4,629,667 12/1986 Kistner et al. ..... 430/950
4,820,615 4/1989 Van Denabell et al. ..... 430/523

*Primary Examiner*—Jack P. Brammer

*Attorney, Agent, or Firm*—Frishauf, Holtz, Goodman & Woodward

[57] ABSTRACT

An improved process for producing a silver halide photographic material that has at least one light-sensitive silver halide emulsion layer on a support as well as at least one hydrophilic colloidal layer coated on both sides of the support. The process is characterized in that the hydrophilic colloidal layers on the two sides of the support are dried simultaneously and that a matting agent having a particle size of at least 4 μm is incorporated in the outermost layer on both sides of the support in an amount of at least 4 mg/m$^2$.

9 Claims, No Drawings

PROCESS FOR PRODUCING SILVER HALIDE PHOTOGRAPHIC MATERIALS

BACKGROUND OF THE INVENTION

This invention relates to silver halide photographic materials (hereinafter sometimes referred to simply as "light-sensitive materials") for use in the making of printing plates, as well as a process for producing such light-sensitive materials. More particularly, this invention relates to a process by which light-sensitive materials that feature good contact under vacuum can be produced with high efficiency. The rate of production under the slow drying conditions described in the Japanese patent application No. 228762/1989 is lower than the heretofore practiced process for producing light-sensitive materials and the price of the produced light-sensitive materials will unavoidably increase.

SUMMARY OF THE INVENTION

The present invention has been achieved under these circumstances and has as an object providing a process by which light-sensitive materials that feature good contact under vacuum can be produced with high efficiency.

This object of the present invention can be attained by a process for producing a silver halide photographic material that has at least one light-sensitive silver halide emulsion layer on a support as well as at least one hydrophilic colloidal layer coated on both sides of the support, in which process the hydropyhilic colloidal layers on the two sides of the support are dried simultaneously, and a matting agent having a particle size of at least 4 μm is incorporated in the outermost layer on both sides of the support in an amount of at least 4 mg/m$^2$.

That is, this object of the present invention can be attained by a process for producing a silver halide photographic material containing a support which has a first side and a second side, a light-sensitive silver halide emulsion layer on said first side, a first hydrophilic colloidal layer on said emulsion layer and a second hydrophilic colloidal layer on said second side comprising:

providing said first hydrophilic colloidal layer on said emulsion layer, providing said second hydrophilic colloidal layer on said second side, and drying said first hydrophilic colloidal layer and said second hydrophilic colloidal layer simultaneously, wherein said first hydrophilic colloidal layer and said second hydrophilic colloidal layer have a matting agent with a particle size of not less than 4 μm in an amount of not less than 4 mg/m$^2$.

wherein said first hydrophilic colloidal layer and said second hydrophilic colloidal layer have a smooster value of not less than 25 mmHg.

DETAILED DESCRIPTION OF THE INVENTION

For enhancing the contact between films under vacuum, the use of a matting agent comprising large particles is preferred. However, this type of matting agent can cause a defect named "starry-night effect" and the amount of its use has been limited. This problem could successfully be solved by the technique proposed in the Japanese patent application, supra, which is based on the fact that the settling of the matting agent could be reduced by performing the drying operation in such a way that the weight ratio of water to binder would be reduced from 800% to 200% over a period of at least 35 seconds. However, in order to accomplish such slow drying, it was necessary to reduce the coating speed or extend the drying zone, which eventually led to a lower production rate. As a result of the intensive studies conducted to solve this problem, the present inventors found that the drop in production rate could be avoiled by drying the two coated sides of a light-sensitive material simultaneously. Instead of coating and drying photographic layers on one side of the light-sensitive material at a time, the new method adopts the technique of coating and drying photographic layers on the two sides simultaneously and by so doing, the production rate will increase rather than decrease even if drying is effected at slow speed, whereby the objective of the present invention can be accomplished.

The simultaneous drying of layers on two sides of a light-sensitive material has been found to produce good results not only in production rate but also in the mat quality of the light-sensitive material. The exact mechanism of this improvement is not clear but may be explained as follows: in the conventional "two-pass drying" method, the heat of hot air applied to the side of a light-sensitive material opposite the side to be dried serves to elevate the temperature of the support but in the case of "one-pass drying", layers to be dried are present on both sides of the light-sensitive material and the drying air is used not to increase the temperature of the support but to evaporate the water in the layers of interest.

Photographic layers are usually coated on a light-sensitive material and dried by the following procedure: a coating solution that uses gelatin or some other suitable hydrophilic colloidal material as a binder is applied onto the support; the applied solution is cooled to solidify in cold air having a dry-bulb temperature of −10 to 15° C.; then, the temperature is elevated to remove the water in the coated layer through evaporation. The weight ratio of water to gelatin is typically about 2,000% just after application of the coating solution. As a result of the intensive studies conducted to attain the object of the present invention, the present inventors found that the drying time over which the weight ratio of water to gelatin was reduced from 800% to 200% and the temperature of the coated surface during this period were critical to the purpose of reducing the concentration of the applied coating solution over time in the drying step.

The temperature of the coated surface during the period over which the weight ratio of water to gelatin decreases from 800% to 200% is expressed by the wet-bulb temperature of drying air and is preferably not higher than 19° C., more preferably not higher than 17° C.

Attempts are also being made in the art to improve the antistatic property of light-sensitive materials and the present inventors have shown that increasing the surface smoothness in terms of "smooster" value and providing an antistatic layer is effective for the purpose of preventing the deposition of dust particles on the surface of light-sensitive materials (see commonly assigned Japanese Patent Application No. 228763/1989 and other applications). The surface smoothness degree is a value measured by the method defined in "JAPAN TAPPI Test Method for Paper and Pulp No. 5-74" using an air-micrometer type testing apparatus. The values of the smoothness in terms of "smooster" used in the invention are measured with an instrument, Model SM-6B manufactured by Toh-Ei Electronic Industrial Company. It is also preferred for the object of the present invention that at least one antistatic layer is provided on the support.

It was entirely unexpected that providing an antistatic layer was effective in increasing the surface smoothness in terms of "smooster" value when the coating and drying method of the present invention was applied. When an antistatic layer is provided on the support, the surface of the side on which it is provided preferably has a specific resistance of no higher than $1.0\times10^{12}\Omega$, more preferably $8\times10^{11}\Omega$ and below.

The preferred antistatic layer is either one that at least contains the reaction product of a water-soluble conductive polymer, hydrophobic polymer particles and a curing agent or one that at least contains a fine particulate metal oxide. An example of the water-soluble conductive polymer is a polymer that has at least one conductive group selected from among a sulfonic acid group, a sulfate ester group, a quaternary ammonium salt, a tertiary ammonium salt, a carboxyl group and a polyethylene oxide group. Among these groups, a sulfonic acid group, a sulfate ester group and a quaternary ammonium salt are preferred. The conductive group must be present in an amount of at least 5 wt % per molecule of the water-soluble conductive polymer. The water-soluble conductive polymer also contains a carboxyl group, a hydroxyl group, an amino group, an epoxy group, an aziridine group, an active methylene group, a sulfinic acid group, an aldehyde group, a vinylsulfone group, etc. but, among these, a carboxyl group, a hydroxyl group, an amino group, an epoxy group, an aziridine group or an aldehyde group is preferably contained. These groups must be contained in an amount of at least 5 wt % per molelcule of the polymer. The water-soluble conductive polymer has a number average molecular weight of 3,000–100,000, preferably 3,500–50,000.

Preferred examples of the fine particulate metal oxide include tin oxide, indium oxide, antimony oxide and zinc oxide, which metal oxides may be doped with metallic phosphorus or indium. These fine particulate metal oxides preferably have average particle sizes in the range of 1–0.01 μm.

A matting agent comprising particles with a size of at least 4 μm must be incorporated in an amount of at least 4 mg/m$^2$ in the outermost layer on each side of the support of the light-sensitive material of the present invention.

The matting agent to be used in the present invention may be of any known types including: the particles of inorganic materials such as silica (Swiss Patent No. 330,158), a glass powder (French Patent No. 1,296,995), and alkaline earth metals or carbonates of cadmium, zinc, etc. (British Patent No. 1,173,181); and the particles of organic materials such as starch (U.S. Pat. No. 2,322,037), starch derivatives (Belgian Patent No. 625,451 and British Patent No. 981,198), polyvinyl alcohol (Examined Japanese Patent Publication (JP-B) No. 44-3643), polystyrene or polymethyl methacrylate (Swiss Patent No. 330,158), polyacrylonitrile (U.S. Pat. No. 3,079,257), and polycarbonates (U.S. Pat. No. 3,022,169).

These matting agents may be used either on their own or as admixtures. The shape of the particles of which the matting agents are formed may be regular or irregular. Regular particles are preferably spherical but may assume other forms such as a plate and a cube. The particle size of the matting agents is expressed by the diameter of a sphere having the same volume as that of a particle in the matting agent of interest.

In a preferred embodiment of the present invention, the outermost layer on the side of the support where an emulsion layer is coated contains 4–80 mg/m$^2$ of at least one matting agent comprising regular and/or irregular shaped particles having a size of at least 4 μm. In a more preferred embodiment, said outermost layer contains at least one such matting agent (≧4 μm) in combination with at least one matting agent comprising regular and/or irregular shaped particles with a size of less than 4 μm in a total amount of 4–80 mg/m$^2$.

By the expression "a matting agent is contained in the outermost layer" is meant that at least part of the matting agent need be contained in the outermost layer. If necessary, part of the matting agent may extend beyond the outermost layer to reach the underlying layer.

In order for the matting agent to perform its basic function, part of the matting agent is desirably exposed on the surface. Part or all of the matting agent added may be exposed on the surface. The matting agent may be added either by applying a coating solution that has the matting agent dispersed therein or by spraying the matting agent after a coating solution has been applied but before it is dried. If two or more kinds of matting agents are to be added, the two methods may be employed in combination.

The silver halide emulsion to be used in the light-sensitive material that is produced by the present invention may incorporate any types of silver halides such as silver bromide, silver iodobromide, silver chloride, silver chlorobromide and silver chloroiodobromide that are commonly employed in silver halide emulsions but are in no way to be taken as limiting. Among these, silver chlorobromide containing at least 50 mol % of silver chloride is preferred for making a negative-acting silver halide emulsion. Silver halide grains may be prepared by any of the acid, neutral and ammoniacal methods. The silver halilde emulsions to be used in the present invention may have a single composition, or grains having different compositions may be incorporated in a single layer or separated in more than one layer.

The silver halide grains to be used in the present invention may be of any shape. A preferred shape is a cube having {100} faces on the crystal. Also useful are octahedral, tetradecahedral, duodecahedral or otherwise shaped particles that are prepared by the methods described in such references as U.S. Pat. Nos. 4,183,756, 4,225,666, JP-A-55-26589 and JP-B-55-42737 (the term "JP-A" as used herein means an "unexamined published Japanese patent application"), and J. Photgr. Sci., 21, 39 (1973). Particles having twinned faces may also be used.

The silver halide grains to be used in the present invention may have a single shape or grains having various shapes may be mixed together.

The silver halide grains may have any grain size distribution. Emulsions having a broad grain size distribution (called "polydispersed emulsions") may be used or, alternatively, emulsions having a narrow grain size distribution (named "monodispersed emulsions") may be used either singly or as admixtures. If desired, a polydispersed emulsion may be used in combination with a monodispersed emulsion.

Separately prepared two or more silver halide emulsions may be used as admixtures.

Monodispersed emulsions are preferably used in the present invention. The monodispersed silver halide grains in a monodispersed emulsion are preferably such that the weight of grains having sizes within ±20% of the average size r accounts for at least 60%, more preferably at least 70%, most preferably at least 80%, of the total weight of the grains.

The term "average size r" as used herein may be defined as the grain size ri for the case where the product of ni and $ri^3$ attains a maximum value (in $ni \times ri^3$, ni represents the frequency of the occurrence of grains having the size ri) and it is expressed in three significant figures, with a figure of the least digit being rounded off. The term "grain size" as used herein means the diameter of a spherical silver halide grain, or the diameter of the projected area of a non-spherical grain as reduced to a circular image of the same area.

Grain size may be determined by a direct measurement of the diameter of a grain of interest or its projected area on a print obtained by photographic imaging of that grain under an electron microscope at a magnification of $1\text{–}5 \times 10^4$ (supposing that the grains to be measured are randomly selected to a total number of at least 1,000).

A highly monodispersed emulsion which is particularly preferred for use in the present invention has a spread of distribution of no greater than 20%, more preferably no greater than 15%, as calculated by the following formula:

$$\text{Spread of distribution (\%)} = \frac{\text{Standard deviation of grain size}}{\text{Average grain size}} \times 100$$

where the average grain size and the standard deviation of grain size shall be determined from ri which was already defined above. Monodispersed emulsions can be obtained by making reference to such prior patents as JP-A-54-48521,58-49938 and 60-122935.

The light-sensitive silver halide emulsions to be used in the present invention may be a "primitive" one which has not been subjected to chemical sensitization.

There are no particular limitations on pH, pAg, temperature and other conditions of chemical sensitization. The pH value is preferably in the range of 4–9, more preferably 5–8; the pAg value is preferably held in the range of 5–11, more preferably 8–10; and the temperature is preferably in the range of 40°–90° C., more preferably 45°–75° C.

In the present invention, the above-described silver halide light-sensitive emulsions may be used either independently or as admixtures.

Various known stabilizers may be used in the practice of the present invention. If necessary, silver halide solvents such as thioether or crystal habit modifiers such as mercapto group containing compounds and sensitizing dyes may also be employed.

In the process of grain formation and/or growth, the silver halide grains to be used in the above-described emulsion may have metal ions added using a cadmium salt, a zinc salt, a lead salt, a thallium salt, an iridium salt or a complex salt thereof, a rhodium salt or a complex salt thereof, or an iron salt or a complex salt thereof, so that those metal ions are incorporated in the interior and/or surface of the grains.

In the preparation of silver halide emulsions to be used in the present invention, unwanted soluble salts may be removed after completion of the growth of silver halide grains. If desired, such soluble salts may be left unremoved from the grown silver halide grains. Removal of such soluble salts may be accomplished by the method described under Research Disclosure No. 17643.

The photographic emulsions used in the light-sensitive material produced by the present invention may be spectrally sensitized to blue, green, red or infrared light at relatively long wavelengths using known spectral sensitizers.

If spectral sensitizers are to be used in the present invention, their concentrations are preferably comparable to those employed in ordinary negative-working silver halide emulsions. It is particularly preferred that spectral sensitizers are used at dye concentrations that will not cause a substantial decrease in the intrinsic sensitivity of the silver halide emulsions. Spectral sensitizers are preferably used at concentrations of from ca. $1.0 \times 10^{-5}$ to ca. $5 \times 10^{-4}$ moles, more preferably from ca. $4 \times 10^{-5}$ to ca. $2 \times 10^{-4}$ moles, per mole of silver halide.

The light-sensitive material produced by the present invention preferably has a smoothness of at least 25 mmHg terms of "smooster" value on both sides. The "smooster" value is to be measured with SM-6B or Toei Denshi Kogyo K.K. in the present invention.

For providing sufficient contrastiness to permit use in the art of platemaking, the light-sensitive material to be produced by the present invention desirably contains at least one tetrazolium compound and/or at least one hydrazine compound.

The tetrazolium compounds that can be used in the present invention are represented by the following general formula (I):

(I)

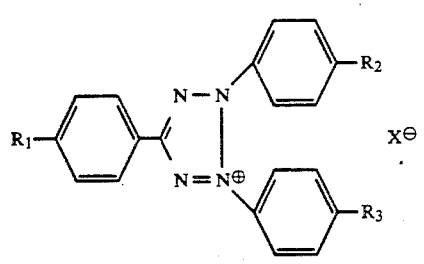

where $R^1$, $R^2$ and $R^3$ are each independently a hydrogen atom or a substituent; and $X^{\ominus}$ is an anion.

Preferred examples of the substituent represented by $R_1$–$R_3$ in the general formula (I) include: an alkyl group (e.g. methyl, ethyl, cyclopropyl, propyl, isopropyl, cyclobutyl, butyl, isobutyl, pentyl or cyclohexyl); an amino group, an acylamino group (e.g. acetylamino); a hydroxyl group; an alkoxylgroup (e.g. methoxy, ethoxy, propoxy, butoxy or pentoxy); an acyloxy group (e.g. acetyloxy); a halogen atom (e.g. F, Cl or Br); a carbamoyl group; an acylthio group (e.g. acetylthio); an alkoxycarbonyl group (e.g. ethoxycarbonyl); a carboxyl group; an acyl group (e.g. acetyl); a cyano group; a nitro group; a mercapto group; a sulfoxy group; and an aminosulfoxy group.

Examples of the anion represented by $X^{\ominus}$ include halide ions such as chloride ion, bromide ion and iodide ion, acid radicals of inorganic acids such as nitric acid, sulfuric acid and perchloric acid, acid radicals of organic acids such as sulfonic acid and carboxylic acid, and anionic activators as specifically exemplified by:

lower alkylbenzenesulfonic acid anions (e.g. p-toluenesulfonic acid anion); higher alkylbenzenesulfonic acid anions (e.g. p-dodecylbenzenesulfonic acid anion); higher alkyl sulfate ester anions (e.g. lauryl sulfate anion); boric acid anions (e.g. tetraphenylboron); dialkyl sulfosuccinate anions (e.g. di-2-ethylhexyl sulfosuccinate anion); polyether alcohol sulfate ester anions (e.g. cetyl polyethenoxysulfate anion); higher aliphatic anions such as stearic acid anion; and polymers having an acid radical attached thereto such as polyacrylic acid anion.

Specific examples of the compounds of the general formula (I) which may be used in the present invention are listed in Table T below but it should be understood that they are by no means intended to limit the scope of the present invention.

TABLE T

| Compound No. | $R_1$ | $R_2$ | $R_3$ | $X^{\ominus}$ |
|---|---|---|---|---|
| I-1 | H | H | H | $Cl^{\ominus}$ |
| I-2 | H | p-$CH_3$ | p-$CH_3$ | $Cl^{\ominus}$ |
| I-3 | H | m-$CH_3$ | m-$CH_3$ | $Cl^{\ominus}$ |
| I-4 | H | o-$CH_3$ | o-$CH_3$ | $Cl^{\ominus}$ |
| I-5 | p-$CH_3$ | p-$CH_3$ | p-$CH_3$ | $Cl^{\ominus}$ |
| I-6 | H | p-$OCH_3$ | p-$OCH_3$ | $Cl^{\ominus}$ |
| I-7 | H | m-$OCH_3$ | m-$OCH_3$ | $Cl^{\ominus}$ |
| I-8 | H | o-$OCH_3$ | o-$OCH_3$ | $Cl^{\ominus}$ |
| I-9 | p-$OCH_3$ | p-$OCH_3$ | p-$OCH_3$ | $Cl^{\ominus}$ |
| I-10 | H | p-$C_2H_5$ | p-$C_2H_5$ | $Cl^{\ominus}$ |
| I-11 | H | m-$C_2H_5$ | m-$C_2H_5$ | $Cl^{\ominus}$ |
| I-12 | H | p-$C_3H_7$ | p-$C_3H_7$ | $Cl^{\ominus}$ |
| I-13 | H | p-$OC_2H_5$ | p-$OC_2H_5$ | $Cl^{\ominus}$ |
| I-14 | H | p-$OCH_3$ | p-$OCH_3$ | $Cl^{\ominus}$ |
| I-15 | H | p-$OCH_3$ | p-$OC_2H_5$ | $Cl^{\ominus}$ |
| I-16 | H | p-$OC_5H_{11}$ | p-$OCH_3$ | $Cl^{\ominus}$ |
| I-17 | H | p-$OC_8H_{17}$-n | p-$OC_8H_{17}$-n | $Cl^{\ominus}$ |
| I-18 | H | p-$C_{12}H_{25}$-n | p-$C_{12}H_{25}$-n | $Cl^{\ominus}$ |
| I-19 | H | p-$N(CH_3)_2$ | p-$N(CH_3)_2$ | $Cl^{\ominus}$ |
| I-20 | H | p-$NH_2$ | p-$NH_2$ | $Cl^{\ominus}$ |
| I-21 | H | p-OH | p-OH | $Cl^{\ominus}$ |
| I-22 | H | m-OH | m-OH | $Cl^{\ominus}$ |
| I-23 | H | p-Cl | p-Cl | $Cl^{\ominus}$ |
| I-24 | H | m-Cl | m-Cl | $Cl^{\ominus}$ |
| I-25 | p-CN | p-$CH_3$ | p-$CH_3$ | $Cl^{\ominus}$ |
| I-26 | p-SH | p-$OCH_3$ | p-$OCH_3$ | $Cl^{\ominus}$ |
| I-27 | H | p-$OCH_3$ | p-$OCH_3$ | 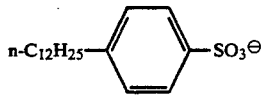 |

The tetrazolium compounds to be used in the present invention can be easily synthesized by known methods, for example, the one described in Chemical Reviews, 55, 335–483.

The tetrazolium compounds represented by the general formula (I) are preferably used in amounts ranging from about 1 mg to 10 g, more preferably from about 10 mg to about 2 g, per mole of the silver halide contained in the silver halide photographic material.

The tetrazolium compounds represented by the general formula (I) may be used either singly or as admixtures of two or more compounds in suitable proportions. If desired, the tetrazolium compounds of the general formula (I) may be used in combination with other tetrazolium compounds in suitable proportions.

Particularly good results are obtained if the tetrazolium compounds of the general formula (I) are used in combination with anions that bind to those compounds and that reduce their hydrophilicity. Examples of such anions include: acid radicals of inorganic acids such as perchloric acid; acid radicals of organic acids such as sulfonic acid and carboxylic acid; and anionic activators as specifically exemplified by lower alkylbenzenesulfonic acid anions (e.g. p-toluenesulfonic acid anion), p-dodecylbenzenesulfonic acid anions, alkylnaphthalenesulfonic acid anions, laurylsulfate anions, tetraphenylborons, dialkylsulfosuccinate anions (e.g. di-2-ethylhexylsulfosuccinate anions), polyether alcohol sulfate ester anions (e.g. cetyl polyethenoxysulfate anion), stearic acid anions, and polyacrylic acid anions.

These anions may be preliminarily mixed with the tetrazolium compounds of the general formula (I) before they are added to hydrophilic colloidal layers. Alternatively, they may be added to silver halide emulsion layers or other hydrophilic colloidal layers that may or may not contain the tetrazolium compounds of the general formula (I).

The hydrazine compounds to be preferably used in the present invention are represented by the following general formula (II):

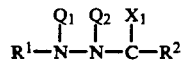

(II)

where $R^1$ is a monovalent organic residue; $R^2$ is a hydrogen atom or a monovalent organic residue; $Q_1$ and $Q_2$ are each a hydrogen atom, an optionally substituted alkylsulfonyl group, or an optionally substituted arylsulfonyl group; $X_1$ is an oxygen atom or a sulfur atom.

Among the compounds represented by the general formula (II), one in which $X_1$ is an oxygen atom and $R^2$ is a hydrogen atom is particularly preferred.

Monovalent organic groups represented by $R^1$ and $R^2$ include aromatic residues, heterocyclic residues and aliphatic residues.

Illustrative aromatic residues include a phenyl group and a naphthyl group, which may have such substituents as alkyl, alkoxyl acylhydrazino, dialkylamino, alkoxycarbonyl, cyano, carboxyl nitro, alkylthio, hydroxyl, sulfonyl, carbamoyl, halogen, acylamino, sulfonamido, and thiourea. Substituted phenyl groups include 4-methylphenyl, 4-ethylphenyl, 4-oxyethylphenyl, 4-dodecylphenyl, 4-carboxyphenyl, 4-diethylaminophenyl, 4-octylaminophenyl, 4-benzylaminophenyl, 4-acetamido-2-methylphenyl, 4-(3-ethylthioureido)phenyl, 4-[2-(2,4-di-tert-butylphenoxy)-butylamido]phenyl and 4-[2-(2,4-di-tert-butylphenoxy)-butylamido]phenyl.

Illustrative heterocyclic residues are 5- or 6-membered single or fused rings having at least one of oxygen, nitrogen, sulfur and selenium atoms. These rings may have substituents. Specific examples of heterocyclic residues include: pyrroline, pyridine, quinoline, indole, oxazole, benzoxazole, naphthoxazole, imidazole, benzimidazole, thiazoline, thiazole, benzothiazole, naphthothiazole, selenazole, benzoselenazole and naphthoselenazole rings.

These hetero rings may be substituted by alkyl groups having 1–4 carbon atoms such as methyl and ethyl, alkoxyl groups having 1–4 carbon atoms such as methoxy and ethoxy, aryl groups having 6–18 carbon atoms such as phenyl, halogen atoms such as chlorine and bromine, alkoxycarbonyl groups, cyano group, amido group, etc.

Illustrative aliphatic residues include straightchained or branched alkyl groups, cycloalkyl groups, substituted alkyl or cycloalkyl groups, alkenyl groups and alkynyl groups. Exemplary straight-chained or branched alkyl groups are alkyl groups having 1–18, preferably 1–8, carbon atoms, such as methyl, ethyl, isobutyl and 1-octyl. Exemplary cycloalkyl groups include those having 3–10 carbon atoms, such as cyclopropyl, cyclohexyl, adamantyl, etc. Substituents on alkyl and cycloalkyl groups include an alkoxylgroup (e.g. methoxy, ethoxy, propoxy or butoxy), an alkoxycarbonyl group, a carbamoyl group, a hydroxyl group, an alkylthio group, an amido group, an acyloxy group, a cyano group, a sulfonyl group, a halogen atom (e.g. Cl, Br, F or I), an aryl group (e.g. phenyl, halogen-substituted phenyl or alkyl-substituted phenyl), etc. Specific examples of substituted cycloalkyl group include 3-methoxypropyl, ethoxycarbonylmethyl, 4-chlorocyclohexyl, benzyl, p-methylbenzyl and p-chlorobenzyl. An exemplary alkenyl group is an allyl group, and an exemplary alkynyl group is a propargyl group.

Preferred examples of the hydrazine compound that can be used in the present invention are listed below and it should be understood that they are by no means intended to limit the scope of the present invention.

(II-1) 1-Formyl-2-[4[2[(2,4-di-tert-butylphenoxy)-butylamido]phenyl]-hydrazine;
(II-2) 1-Formyl-2-(4-diethylaminophenyl)hydrazine;
(II-3) 1-Formyl-2-(p-toly)hydrazine;
(II-4) 1Formyl-2-(4-ethylphenyl)hydrazine;
(II-5) 1-Formyl-2-(4-acetamido-2-methylphenyl)hydrazine;
(II-6) 1-Formyl-2-(4-oxyethylphenyl)hydrazine;
(II-7) 1-Formyl-2-(4-N,N-dihydroxyethylaminophenyl)hydrazine;
(II-8) 1-Formyl-2-[4-(3-ethylthioureido)phenyl]hydrazine;
(II-9) 1-Thioformyl-2-[4-[2-(2,4-di-tert-butylphenoxy)-butylamido]phenyl]hydrazine;
(II-10) 1-Formyl-2-(4-benzylaminophenyl)hydrazine;
(II-11) 1-Formyl-2-(4-octylaminophenyl)hydrazine;
(II-12) 1-Formyl-2-(4-dodecylphenyl)hydrazine;
(II-13) 1-Acetyl-2-[4-[2-(2,4-di-tert-butylphenoxy)-butylamido]-phenyl]hydrazine;
(II-14) 4-Carboxyphenylhydrazine;
(II-15) 1-Acetyl-1-(4-methylphenylsulfonyl)-2-phenylhydrazine;
(II-16) 1-Ethoxycarbonyl-1-(4-methylphenylsulfonyl)-2-phenylhydrazine;
(II-17) 1-Formyl-2-(4-hydroxyphenyl)-2-(4-methylphenylsulfonyl)hydrazine;
(II-18) 1-(4-Acetoxyphenyl)-2-formyl-1-(4-methylphenylsulfonyl)hydrazine;
(II-19) 1-Formyl-2-(4-hexanoxyphenyl)-2-(4-methylphenylsulfonyl)hydrazine;
(II-20) 1-Formyl-2-[4-(tetrahydro-2H-pyran-2-yloxy)-phenyl]-2-(4-methylphenylsulfonyl)-hydrazine;
(II-21) 1-Formyl-2-[4-(3-hexylureidophenyl)]-2-(4-methylphenylsulfonyl)hydrazine;
(II-22) 1-Formyl-2-(4-methylphenylsulfonyl)-2-[4-phenoxythiocarbonylamino)-phenyl]hydrazine;
(II-23) 1-(4-Ethoxythiocarbonylaminophenyl)-2-formyl-1-(4-methylphenylsulfonyl)hydrazine;
(II-24) 1-Formyl-2-(4-methylphenylsulfonyl)-2-[4-(3-methyl-3-phenyl-2-thioureido)phenyl]hydrazine;
(II-25) 1-{{4-{3-[4-(2,4-bis-t-amylphenoxy)-butyl-]ureido}-phenyl}}-2-formyl-1-(4-methylphenylsulfonyl)hydrazine;

II-26

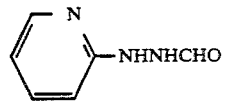

II-27

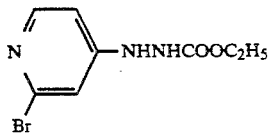

II-28

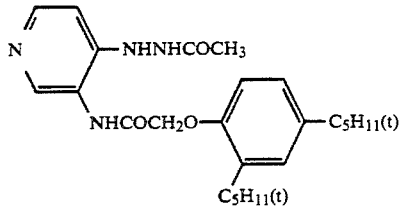

-continued
II-29
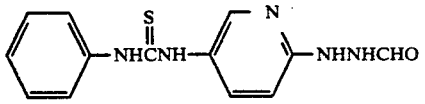
II-30
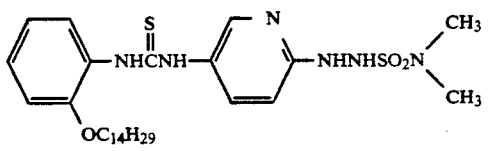
II-31
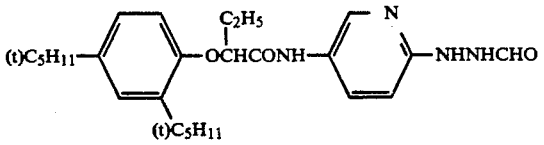
II-32
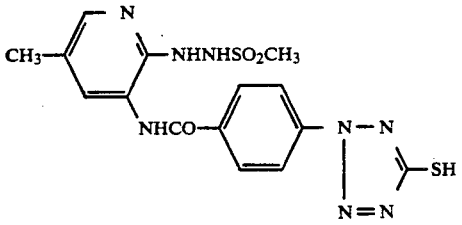
II-33
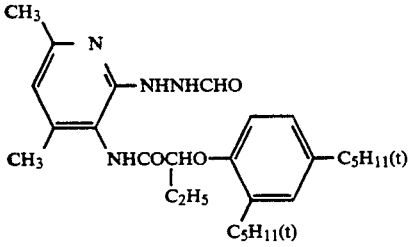
II-34
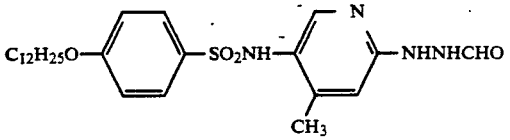
II-35
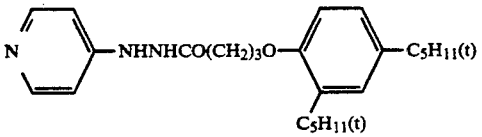
II-36
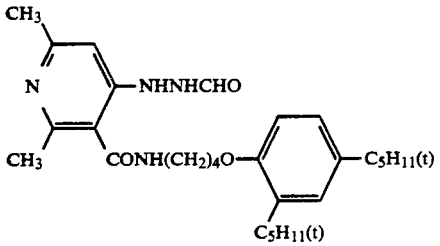
II-37
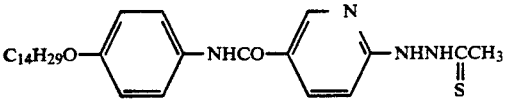

-continued
II-38
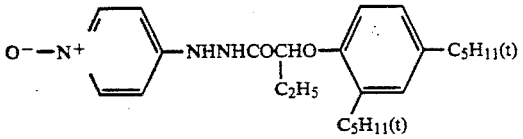
II-39
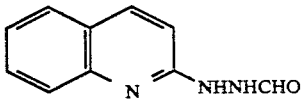
II-40
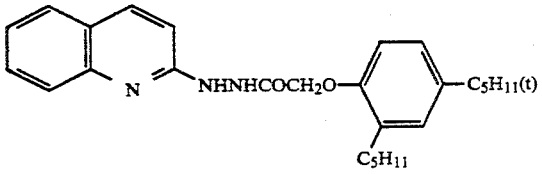
II-41
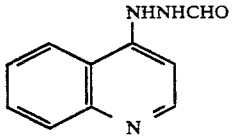
II-42
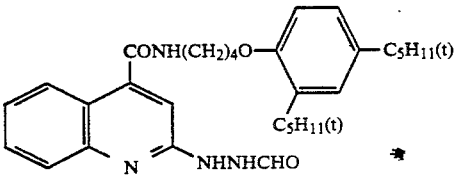
II-43
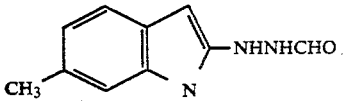
II-44
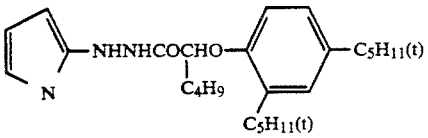
II-45
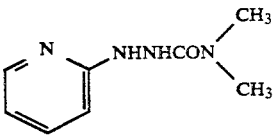
II-46
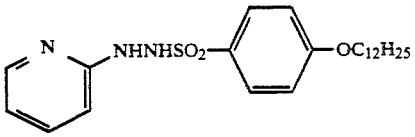
II-47
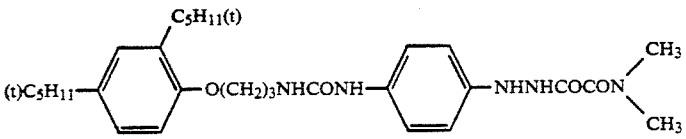

-continued
II-48
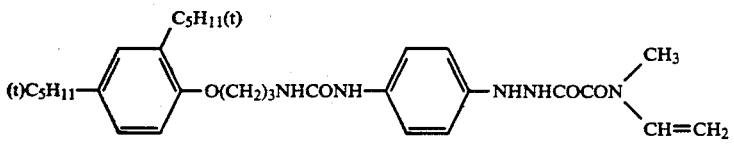
II-49
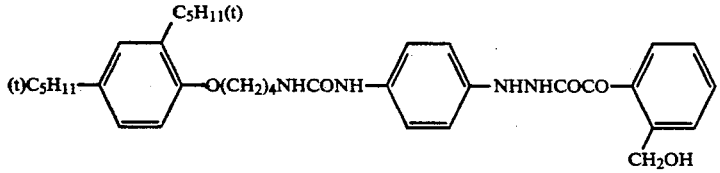
II-50
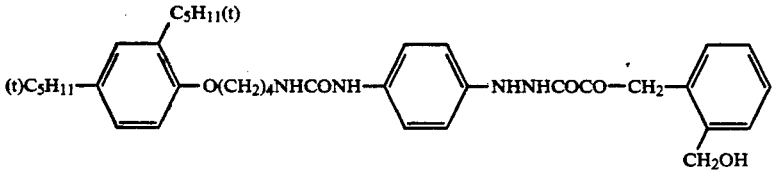
II-51
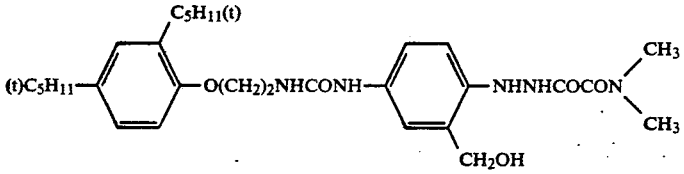
II-52
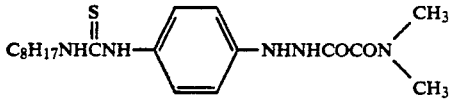
II-53
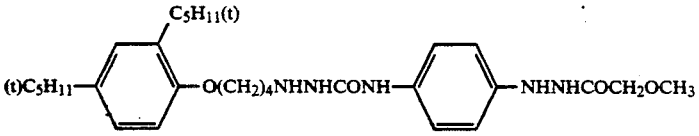
II-54
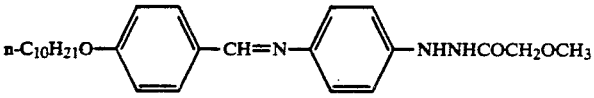
II-55
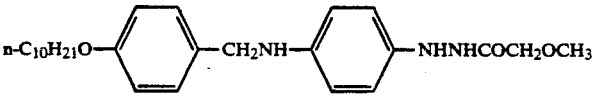
II-56
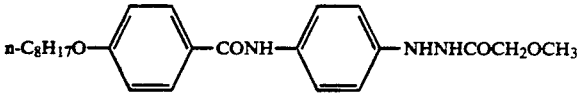
II-57
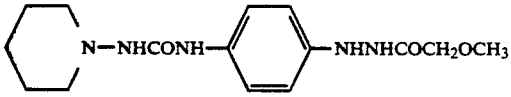
II-58
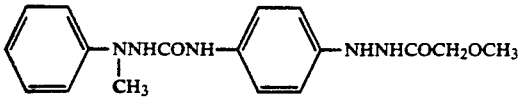

-continued

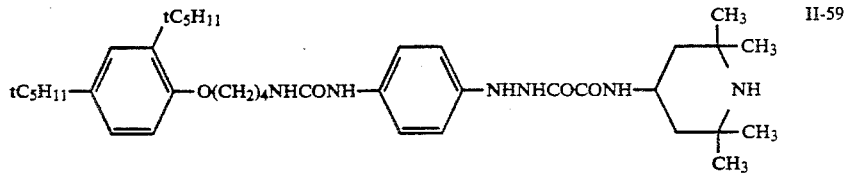

The hydrazine compounds of the general formula (II) are incorporated in a silver halide emulsion layer and/or in a non-light-sensitive layer that is on the same side of a support as where a silver halide emulsion layer is present. Preferably, the hydrazine compounds are incorporated in a silver halide emulsion layer and/or an underlying layer. The hydrazine compounds are preferably added in amounts of $10^{-5}$–$10^{-1}$ mole per mole of silver, more preferably $10^{-4}$–$10^{-2}$ mole per mole of silver.

Dyes, uv absorbers and other additives, if they are incorporated in the silver halide photographic material produced by the present invention, may be mordanted with cationic polymers or the like.

In order to prevent the occurrence of sensitivity drop of fogging during the production, storage or processing of silver halide photographic materials, various known compounds such as stabilizers may be incorporated in the photographic emulsion described above.

Coating solutions to be used in producing silver halide photographic materials by the method of the present invention preferably have a pH in the range of 5.3–7.5. When a plurality of layers are to be formed in superposition, the coating solution prepared by mixing the coating solutions for the respective layers in their predetermined proportions preferably has a pH within the above-stated range of 5.3–7.5. If the pH is lower than 5.3, the applied coating will harden at an unacceptably slow speed, whereas the photographic performance of the final product will be adversely affected if the pH is higher than 7.5.

Depending upon a specific object, the light-sensitive material produced by the present invention may incorporate various additives. A detailed description of useful additives is given in Research Disclosure, Item 17643 (December 1978) and ibid., Item 18716 (November 1979) and the relevant portion of the description is summarized in the table below.

| Additive | RD 17643 | RD 18716 |
|---|---|---|
| 1. Chemical sensitizer | p. 23 | p. 648, right col. |
| 2. Sensitivity improver | | p. 648, right col. |
| 3. Spectral sensitizer Supersensitizer | pp. 23–24 | p. 648, right col. to p. 649, right col. |
| 4. Brightener | p. 24 | |
| 5. Antifoggant Stabilizer | pp. 24–25 | p. 649, right col. |
| 6. Light absorber Filter dye UV absorber | pp. 25–26 | p. 649, right col. to p. 650, left col. |
| 7. Antistain agent | p. 25 right col. | p. 650, left and right col. |
| 8. Dye image stabilizer | p. 25 | |
| 9. Hardener | p. 26 | p. 651, left col. |
| 10. Binder | p. 26 | p. 651, left col. |
| 11. Plasticizer Lubricant | p. 27 | p. 650, right col. |
| 12. Coating aid Surfactant | pp. 26–27 | p. 650, right col. |
| 13. Antistat | p. 27 | p. 650, right col. |

Known supports may be used for the light-sensitive material to be produced by the present invention. Polyethylene terephthalate supports are used with particular preference.

Known subbing layers may be used in the present invention.

The following examples are provided for the purpose of further illustrating the present invention but are in no way to be taken as limiting.

EXAMPLE 1

Samples of negative-acting silver halide photographic material for use as silver halide light-sensitive materials for daylight type contact use were prepared by the following procedure.

PREPARATION OF EMULSIONS

A silver chlorobromide emulsion containing 2 mol % AgBr was prepared as follows.

As aqueous solution containing 23.9 mg of potassium pentabromorhodate per 60 g of silver nitrate, sodium chloride and potassium bromide and an aqueous solution of silver nitrate were mixed in an aqueous gelatin solution under agitation by a doublejet method at 40° C. for 25 minutes to prepare a silver chlorobromide emulsion comprising grains with an average size of 0.20 μm.

To the emulsion, 200 mg of 6-methyl-4-hydroxy-1,3,3a, 7-tetraazaindene (stabilizer) was added and the mixture was washed with water and desalted. To the desalted mixture, 20 mg of 6-methyl-4-hydroxy-1,3,3a, 7-tetraazaindene was added and the mixture was subjected to sulfur sensitization. Thereafter, the necessary amount of gelatin was added and 6-methyl-4-hydroxy-1,3,3a, 7-tetraazaindene was further added as a stabilizer. Subsequently, the mixture was worked up with water to a total volume of 260 ml, whereby a complete emulsion was obtained.

PREPARATION OF LATEX (L) FOR ADDITION TO THE EMULSION

A sodium salt of dextran sulfate (0.25 kg; KMDS of Meito Sangyo Co., Ltd.) and 0.05 kg of ammonium persulfate were added to 40 L of water. To the stirred solution (81° C.), a mixture of 4.51 kg of n-butyl acrylate, 5.49 kg of styrene and 0.1 kg of acrylic acid was added under a nitrogen stream over a period of 1 h. Thereafter, 0.005 kg of ammonium persulfate was added and the mixture was stirred for 1.5 h, cooled and adjusted to a pH of 6 with aqueous ammonia.

The resulting latex solution was filtered through Whatman GF/D filter and worked up with water to a total volume of 50.5 kg, whereby a monodispersed latex (L) comprising particles with an average size of 0.25 μm was prepared.

The additives listed below were added to the previously prepared emulsion and a coating solution A for silver halide emulsion layer was prepared as described below.

PREPARATION OF EMULSION COATING SOLUTION A

Nine milligrams of compound (A) was added as a biocide to the previously prepared emulsion. The pH of the mixture was adjusted to 6.5 with 0.5N sodium hydroxide. Subsequently, 360 mg of compound (T) was added. Further, 5 ml of a 20% solution of saponin, 180 mg of sodium dodecylbenzenesulfonate, 80 mg of 5-methylbenzotriazole and 43 ml of latex solution (L) were added, with all amounts being based on one mole of silver halide. Thereafter, 60 mg of compound (M) and 280 mg of a water-soluble styrene-maleic acid copolymer (thickener) were successively added and the mixture was worked up with water to a total volume of 475 ml to prepare coating solution A for emulsion layer.

Then, a coating solution B for emulsion protective layer was prepared in the following manner.

PREPARATION OF COATING SOLUTION B

Pure water was added to gelatin to swell it and the swollen gelatin was dissolved at 40° C. Thereafter, 32.7 mg/m$^2$ of compound (Z) as a coating aid, 100 mg/m$^2$ of compound (N) as a filter dye, and 70 mg/m$^2$ of compound (D) were successively added. Further, two matting agents, one being silica comprising irregular shaped particles smaller than 4 μm and the other being silica comprising irregular shaped particles of a size 4 μm and more, were added at respective amounts of 5 mg/m$^2$ and 20 mg/m$^2$, and the mixture was adjusted to pH 5.4 with a solution of citric acid.

Compound (T):

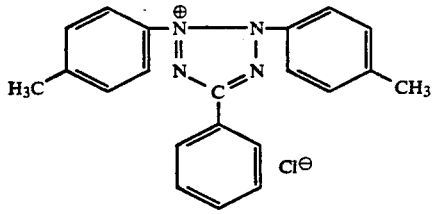

Compound (Z):

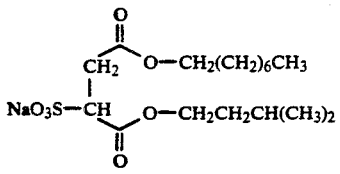

Compound (M):

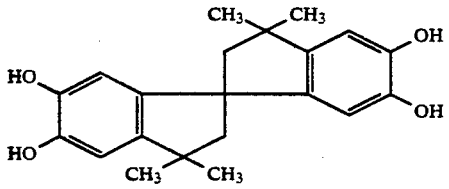

Compound (N):

-continued

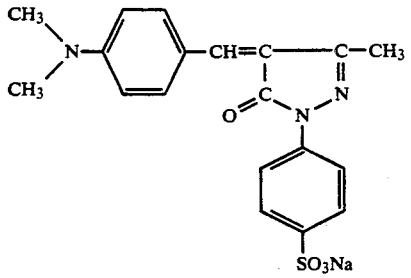

Compound (A):

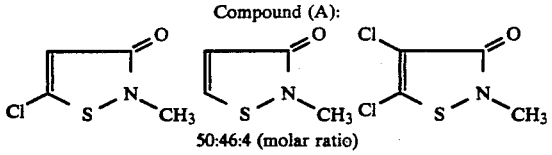

50:46:4 (molar ratio)

Compound (D):

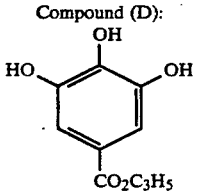

A coating solution C for backing layer was subsequently prepared in the following manner.

PREPARATION OF BACKING COATING SOLUTION C

Gelatin (36 g) was swollen in water and heated to dissolve in water. Thereafter, three dye compounds (C-1), (C-2) and (C-3) were added to water in respective amounts of 1.6 g, 310 mg and 1.9 g, and 2.9 g of compound (N) was also as an aqueous solution. The resulting aqueous solution was added to the gelatin solution. Subsequently, 11 ml of a 20% aqueous solution of saponin, 5 g of compound (C-4) as a physical property modifier and 63 mg of a methanol solution of compound (C-5) were added. Compound C-6 was added as a suspension of the fine solid crystallines formed by lowering to 6.0 the pH of an aqueous 1% solution prepared at pH10. To the resulting solution, 800 g of a water-soluble styrene-maleic acid copolymer was added as a thickener to adjust the viscosity of the solution. Further, the pH of the solution was adjusted to 5.4 with an aqueous solution of citric acid. Finally, 144 mg of glyoxal was added and the solution was worked up with water to a total volume of 960 ml to prepare a backing coating solution C.

Compound (C-1):

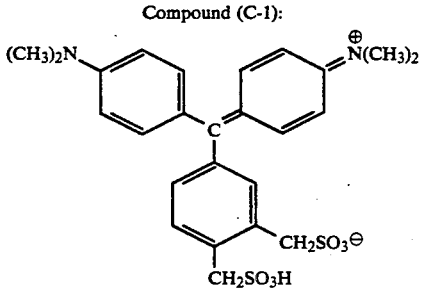

Compound (C-2):

-continued

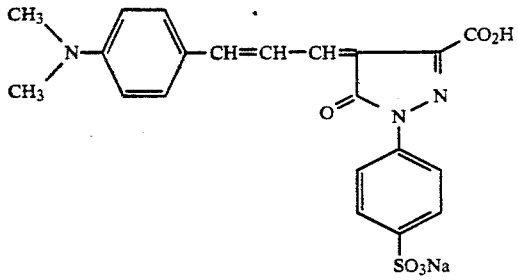

Compound (C-3):

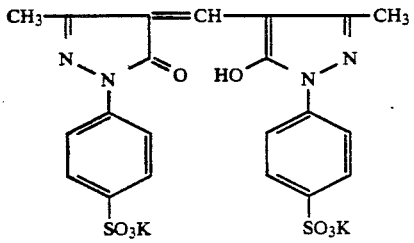

Compound (C-4):
Copolymer latex of

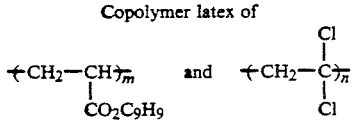

(m:n = 1:1)

Compound (C-5):

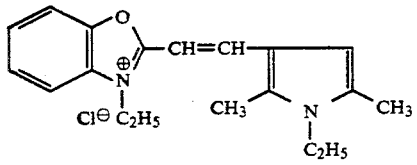

Compound (C-6)

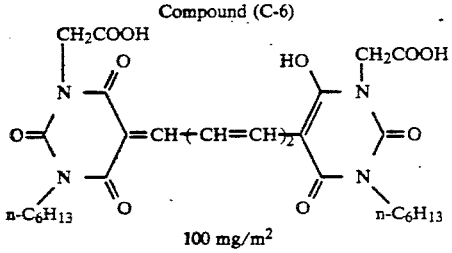

100 mg/m²

Subsequently, a coating solution D for backing protective layer was prepared in the following manner.

PREPARATION OF COATING SOLUTION D

Gelatin (50 g) was swollen in water and heated to dissolve in water. Thereafter, a sodium salt of bis(2-ethylhexyl)-2-sulfosuccinate, sodium chloride, glyoxal and mucochloric acid were added in respective amounts of 340 mg, 3.4 g, 1.1 g and 540 mg. To the resulting mixture, a polymethyl methacrylate powder comprising spherical particles with an average size of 4 μm was added as a matting agent to provide a coat weight of 40 mg/m². The mixture was worked up with water to a total volume of 1,000 ml to prepare coating solution D for backing protective layer.

Just prior to application, both the emulsion coating solution and the backing coating solution were mixed with a solution containing $(CH_2{=}CHSO_2CH_2)_2O$ and HCHO as hardeners.

PREPARATION OF TEST SAMPLES

Polyethylene terephthalate films (100 μm thick) were subbed in accordance with Example 1 described in JP-A-59-19941 and used as supports. Coating solutions C and D were applied simultaneously onto the supports, with solution C being applied closer to the supports. Coating solutions A and B were applied to the opposite side of each support, with solution A being applied closer to the support. The coating schedule was as follows: using a slide hopper, coating solutions A and B were applied to the supports, which were then passed through a cold air setting zone so that the emulsion layer and the emulsion protective layer would set; thereafter, solutions C and D were applied onto the other side of the supports, which were then passed through a cold air setting zone so that the backing layer and the backing protective layer would set; subsequently, the supports were passed through a drying zone to dry both sides of the supports simultaneously. After the coating of the backing layer and the backing protective layer, the supports were transported in such a way that they would not contact rollers or any other objects until the coatings were completely dry and the webs were wound up on a takeup drum. Coating by this procedure is hereinafter referred to as a "one pass method".

As a comparison, the backing layer and the backing protective layer were coated and dried and the webs were wound up on a takeup drum; thereafter, the emulsion layer and the emulsion protective layer were coated on the other side of the supports and the webs were then taken up. Coating by this procedure is referred to as a "two pass method".

Test sample Nos. 1–4 were prepared in accordance with the coating and drying conditions shown in Table 1.

In each coating and drying operation, the films in which the water to gelatin weight ratio decreased to 200% and below were dried with air at 34° C. and 30% r.h. and 10 seconds after the film surface temperature reached 33° C., they were contacted with air at 50° C. and 25% r.h. for 45 seconds; the thus dried films were taken up at 25° C. and 45% r.h.; thereafter, the films were cut into predetermined lengths and packaged with their absolute humidity kept at the value indicated above.

The coating weight of gelatin was 2.0 g/m² in the backing layer, 1.5 g/m² in the backing protective layer, 2.0 g/m² in the emulsion layer, and 1.0 g/m² in the emulsion protective layer. The silver deposit was 3.5 g/m².

The test samples thus prepared were subjected to the evaluation of "smooster" value and starry-night effect by the following methods and the results are shown in Table 1.

METHODS OF EVALUATION

Smooster value

The unexposed samples were processed under the conditions described below, held in a controlled atmosphere at 23° C. and 48% r.h. for 2 h, and had their "smooster" values measured with SM-6B of Toei Denshi Kogyo K.K. Starry-night effect:

The emulsion coated side of each sample was brought into intimate contact with a clear base, exposed to provide a density of 2.0 and subsequently processed. The appearance of the processed samples was visually checked and the results were evaluated by a five-score rating method, with 5 being the best and 1 being poor.

PROCESSING CONDITIONS

| Steps | Temperature, °C. | Time, sec |
|---|---|---|
| Development | 34 | 15 |
| Fixing | 34 | 15 |
| Washing | R.T. | 10 |
| Drying | 40 | 9 |

FORMULA OF DEVELOPING SOLUTION

Recipe A

| | |
|---|---|
| Pure water (ion-exchanged water) | 150 ml |
| Ethylenediaminetetraacetic acid disodium salt | 2 g |
| Diethylene glycol | 50 g |
| Potassium sulfite (55% w/v aq. sol.) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium hydroxide | q.s. to adjust the pH of developing solution to 10.9 |
| Potassium bromide | 4.5 g |

Recipe B

| | |
|---|---|
| Pure water (ion-exchanged water) | 3 ml |
| Diethylene glycol | 50 g |
| Ethylenediaminetetraacetic acid disodium salt | 25 mg |
| Acetic acid (90% aq. sol.) | 0.3 ml |
| 5-Nitroindazole | 110 mg |
| 1-Phenyl-3-pyrazolidone | 500 mg |

Just before use, recipes A and B were successively dissolved in 500 ml of water and the mixture was worked up to a total volume of 1,000 ml.

FORMULA OF FIXING SOLUTION

Recipe A

| | |
|---|---|
| Ammonium thiosulfate (72.5% w/v aq. sol.) | 230 ml |
| Sodium sulfite | 9.5 g |
| Sodium acetate ($3H_2O$) | 15.9 g |
| Boric acid | 6.7 g |
| Sodium citrate ($2H_2O$) | 2 g |

-continued

| | |
|---|---|
| Acetic acid (90% w/w aq. sol.) | 8.1 ml |

Recipe B

| | |
|---|---|
| Pure water (ion-exchanged water) | 17 ml |
| Sulfuric acid (50% w/w aq. sol.) | 5.8 g |
| Aluminum sulfate (aq. sol. with 8.1% w/w of $Al_2O_3$) | 26.5 g |

Just prior to use, recipes A and B were successively dissolved in 500 ml of water and the mixture was worked up to a total volume of 1,000 ml. The worked up fixing solution had a pH of ca. 4.3.

TABLE 1

| Sample No. | Drying time | Coating method | Coating speed, m/min | Time for the latter stage of drying, sec. | Maximum surface temperature in the latter stage of drying, °C. | Surface smooster value: emulsion layer | Surface smooster value: backing layer | Starry-night effect | Remarks |
|---|---|---|---|---|---|---|---|---|---|
| 1 | 112 | one pass | 75 | 35 | 14 | 65 | 150 | 5 | Invention |
| 2 | 84 | one pass | 100 | 26 | 19 | 45 | 132 | 4 | Invention |
| 3 | 112 | two pass | 75 | 35 | 14 | 48 | 135 | 4 | Comparison |
| 4 | 84 | two pass | 100 | 26 | 19 | 23 | 82 | 3 | Comparison |

Notes:
(A) Drying time: Time (sec) from the start of coating to the end of drying (until the water to binder weight ratio dropped to 20%)
(B) Coating method: "One pass" was the method adopted by the present invention and "two pass" was the comparative method in which one side was coated at a time, requiring two applications per sample.
(C) Latter stage of drying: The period required for the water to binder weight ratio to decrease from 800% to 200%.

Table 1 shows the following: sample No. 1 coated and dried in accordance with the present invention was improved in the surface smooster value and starry-night effect over corresponding comparative sample No. 3 that was processed in the same manner as sample No. 1 except for the coating and drying scheme; sample No. 2 was also coated and dried in accordance with the present invention but it was coated at a faster rate than sample No. 1, with the drying speed in the latter stage of drying being also faster, and this sample was also improved over corresponding comparative sample No. 4. Comparison between sample Nos. 1 and 2 shows that the effectiveness of the method of the present invention did not decrease even when the drying speed was increased.

EXAMPLE 2

Additional sample Nos. 5–8 were prepared as in Example 1 except that the support was coated with an antistatic layer (for its formula, see below) on the side where the backing layer was formed. The samples were evaluated in the same manner as in Example 1 and the results are shown in Table 2.

COATING THE ANTISTATIC LAYER

A subbed polyethylene terephthalate base was subjected to corona discharge at 50 W/m.min and an antistatic layer was coated to the formula shown below using a roll fit coating pan and an air knife. The drying scheme consisted of heating at 90° C. for 2 min, followed by heating at 140° C. for 90 sec. After the drying, the antistatic layer had a specific surface resistance of $1\times10^8$ at 23° C. and 55% r.h.

FORMULA OF ANTISTATIC LAYER

Polymer (A) 0.6 g/m$^2$

-continued

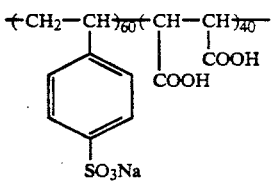

$\overline{M}n = 5000$

Polymer particles (B) 0.38 g/m²

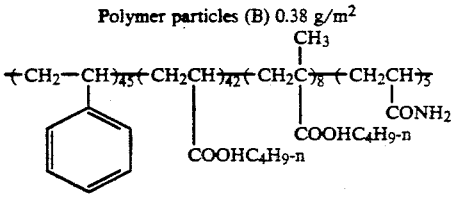

Hardener (C) 0.15 g/m²

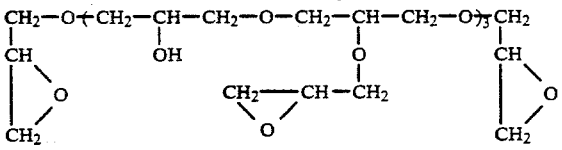

Nonionic surfactant (D)
$HO(CH_2CH_2O)_{35}H$ 0.068/m²

TABLE 2

| Sample No. | Drying time, sec | Surface smooster value emulsion layer | Surface smooster value backing layer | Starry-night effect | Remarks |
|---|---|---|---|---|---|
| 5 | 112 | 73 | 155 | 5 | Invention |
| 6 | 84 | 51 | 139 | 4 | Invention |
| 7 | 112 | 52 | 142 | 4 | Comparison |
| 8 | 84 | 28 | 90 | 3 | Comparison |

Table 2 shows that the surface smooster value, or the mat quality, was further improved over the results of Example 1 by providing an antistatic layer.

EXAMPLE 3

Additional sample Nos. 9–12 were prepared as in Example 2 except for the following two points: the base was subbed by first spreading a copolymer latex of 95 wt % vinylidene chloride, 3 wt % polymethyl methacrylate and 2 wt % itaconic acid on the surface of a polyethylene terephthalate base, then applying corona discharge at 25 W/m.min, and coating a gelatin layer in a dry thickness of 0.1 μm on the latex layer; and another antistatic layer was provided on the backing side of the support by coating a silica-containing gelatin layer in a thickness of 1.5 um for a coat weight of 0.5 g/m².

Sample Nos. 9–12 were evaluated for their quality in the same manner as in Example 1 and the results are shown in Table 3.

TABLE 3

| Sample No. | Coating time, sec | Surface smooster value emulsion layer | Surface smooster value backing layer | Starry-night effect | Remarks |
|---|---|---|---|---|---|
| 9 | 112 | 76 | 150 | 5 | Invention |
| 10 | 84 | 50 | 142 | 4 | Invention |
| 11 | 112 | 49 | 140 | 4 | Comparison |
| 12 | 84 | 29 | 29 | 3 | Comparison |

As is clear from Table 3, the surface smooster value, or the mat quality, was further improved over the results of Example 1 by providing two antistatic layers.

As described in detail on the foregoing pages, the present invention provides a process by which silver halide photographic materials having good mat quality, or the ability to insure good contact under vaccum for exposure, can be produced with high efficiency.

What is claimed is:

1. A process for producing a silver halide photographic material containing a support which has a first side and a second side, a light-sensitive silver halide emulsion layer on said first side, a first hydrophilic colloidal layer on said emulsion layer and a second hydrophilic colloidal layer on said second side, comprising:

providing said first hydrophilic colloidal layer on said emulsion layer, providing said second hydrophilic colloidal layer on said second side, and drying said first hydrophilic colloidal layer and said second hydrophilic colloidal layer simultaneously, wherein said first hydrophilic colloidal layer and said second hydrophilic colloidal layer have a matting agent with a particle size of not less than 4 μm in an amount of not less than 4 mg/m², wherein said first hydrophilic colloidal layer and said second hydrophilic colloidal layer have a smooster value of not less than 25 mmHg.

2. A process according to claim 1 wherein the hydrophilic colloidal layers are dried with the coated surface kept at 19° C. and below until the weight ratio of water to gelatin decreases from 800% to 200%.

3. A process according to claim 2 wherein the hydrophilic colloidal layers are dried with the coated surface kept at 17° C. and below until the weight ratio of water to gelatin decreases from 800% to 200%.

4. A process according to claim 1 wherein said matting agent having a particle size of at least 4 μm is incorporated in an amount of 4–80 mg/m² in the outermost layer on the side of the support where the emulsion layer is provided.

5. A process according to claim 1 wherein at least one antistatic layer is provided on the support.

6. A process according to claim 1 wherein said silver halide photographic material contains at least one tetrazolium compound represented by the following general formula (I):

(I)

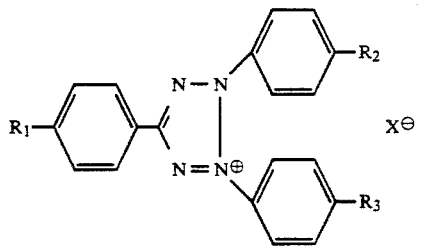

where $R_1$, $R_2$ and $R_3$ each represents a hydrogen atom or a substituent; and $X^{\ominus}$ is an anion.

7. A process according to claim 1 wherein said silver halide photographic material contains at least one hydrazine compound represented by the following general formula (II):

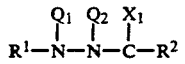

(II)

(where $R^1$ is a monovalent organic residue; $R^2$ is a hydrogen atom or a monovalent organic residue; $Q_1$ and $Q_2$ are each a hydrogen atom, an optionally substituted alkylsulfonyl group, or an optionally substituted arylsulfonyl group; $X_1$ is an oxygen atom or a sulfur atom.

8. A process according to claim 7 wherein said hydrazine compound is added in an amount of $10^{-5}$ to $10^{-1}$ mol per mole of silver.

9. A process according to claim 7 wherein said hydrazine compound is added to the silver halide emulsion layer and/or an underlying layer.

* * * * *